US005956966A

United States Patent [19]

Wendell

[11] Patent Number: 5,956,966

[45] Date of Patent: Sep. 28, 1999

[54] KEG TAP COOLING DEVICE

[76] Inventor: Danny M. Wendell, 302 1st Ave. Northeast, Badger, Iowa 50516

[21] Appl. No.: 09/121,341

[22] Filed: Jul. 23, 1998

[51] Int. Cl.[6] ..... B67D 5/62

[52] U.S. Cl. ..... 62/389; 62/457.4

[58] Field of Search ..... 62/389, 393, 396, 62/398, 457.4

[56] References Cited

U.S. PATENT DOCUMENTS 2,331,834 10/1943 Harr ..... 225/3

4,802,344 2/1989 Livingston et al. ..... 62/372

*Primary Examiner*—Henry Bennett
*Assistant Examiner*—Melvin Jones

[57] ABSTRACT

A keg tap cooling device for keeping a keg tap cool to help prevent excessive foaming of beer poured from the keg tap. The device includes an elongate tube having open top and bottom ends. The bottom end of the tube is adapted for receiving therein a keg tap mounted to the top end of a beverage keg such that a pour tube of the keg tap extends in the lumen of the tube towards the top end of the tube. The lumen of the tube is adapted for holding a cooling material therein for cooling the pour tube of the keg tap in the lumen.

11 Claims, 3 Drawing Sheets

KEG TAP COOLING DEVICE

BACKGROUND OF THE INVENTION

1. Field of the Invention

The present invention relates to beverage keg accessories and more particularly pertains to a new keg tap cooling device for keeping a keg tap cool to help prevent excessive foaming of beer poured from the keg tap.

2. Description of the Prior Art

The use of beverage keg accessories is known in the prior art. More specifically, beverage keg accessories heretofore devised and utilized are known to consist basically of familiar, expected and obvious structural configurations, notwithstanding the myriad of designs encompassed by the crowded prior art which have been developed for the fulfillment of countless objectives and requirements.

Known prior art beverage kegs and beverage keg accessories include U.S. Pat. No. 4,481,791; U.S. Pat. No. 4,802,344; U.S. Pat. No. 5,583,157; U.S. Pat. No. 4,242,884; U.S. Pat. No. Des. 362,789; and U.S. Pat. No. 2,214,344.

While these devices fulfill their respective, particular objectives and requirements, the aforementioned patents do not disclose a new keg tap cooling device. The inventive device includes an elongate tube having open top and bottom ends. The bottom end of the tube is adapted for receiving therein a keg tap mounted to the top end of a beverage keg such that a pour tube of the keg tap extends in the lumen of the tube towards the top end of the tube. The lumen of the tube is adapted for holding a cooling material therein for cooling the pour tube of the keg tap in the lumen.

In these respects, the keg tap cooling device according to the present invention substantially departs from the conventional concepts and designs of the prior art, and in so doing provides an apparatus primarily developed for the purpose of keeping a keg tap cool to help prevent excessive foaming of beer poured from the keg tap.

SUMMARY OF THE INVENTION

In view of the foregoing disadvantages inherent in the known types of beverage keg accessories now present in the prior art, the present invention provides a new keg tap cooling device construction wherein the same can be utilized for keeping a keg tap cool to help prevent excessive foaming of beer poured from the keg tap.

The general purpose of the present invention, which will be described subsequently in greater detail, is to provide a new keg tap cooling device apparatus and method which has many of the advantages of the beverage keg accessories mentioned heretofore and many novel features that result in a new keg tap cooling device which is not anticipated, rendered obvious, suggested, or even implied by any of the prior art beverage keg accessories, either alone or in any combination thereof.

To attain this, the present invention generally comprises an elongate tube having open top and bottom ends. The bottom end of the tube is adapted for receiving therein a keg tap mounted to the top end of a beverage keg such that a pour tube of the keg tap extends in the lumen of the tube towards the top end of the tube. The lumen of the tube is adapted for holding a cooling material therein for cooling the pour tube of the keg tap in the lumen.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new keg tap cooling device apparatus and method which has many of the advantages of the beverage keg accessories mentioned heretofore and many novel features that result in a new keg tap cooling device which is not anticipated, rendered obvious, suggested, or even implied by any of the prior art beverage keg accessories, either alone or in any combination thereof.

It is another object of the present invention to provide a new keg tap cooling device which may be easily and efficiently manufactured and marketed.

It is a further object of the present invention to provide a new keg tap cooling device which is of a durable and reliable construction.

An even further object of the present invention is to provide a new keg tap cooling device which is susceptible of a low cost of manufacture with regard to both materials and labor, and which accordingly is then susceptible of low prices of sale to the consuming public, thereby making such keg tap cooling device economically available to the buying public.

Still yet another object of the present invention is to provide a new keg tap cooling device which provides in the apparatuses and methods of the prior art some of the advantages thereof, while simultaneously overcoming some of the disadvantages normally associated therewith.

Still another object of the present invention is to provide a new keg tap cooling device for keeping a keg tap cool to help prevent excessive foaming of beer poured from the keg tap.

Yet another object of the present invention is to provide a new keg tap cooling device which includes an elongate tube having open top and bottom ends. The bottom end of the tube is adapted for receiving therein a keg tap mounted to the top end of a beverage keg such that a pour tube of the keg tap extends in the lumen of the tube towards the top end of the tube. The lumen of the tube is adapted for holding a cooling material therein for cooling the pour tube of the keg tap in the lumen.

Still yet another object of the present invention is to provide a new keg tap cooling device that is easily mountable to the top end of a beverage keg to help keep the keg tap cool.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
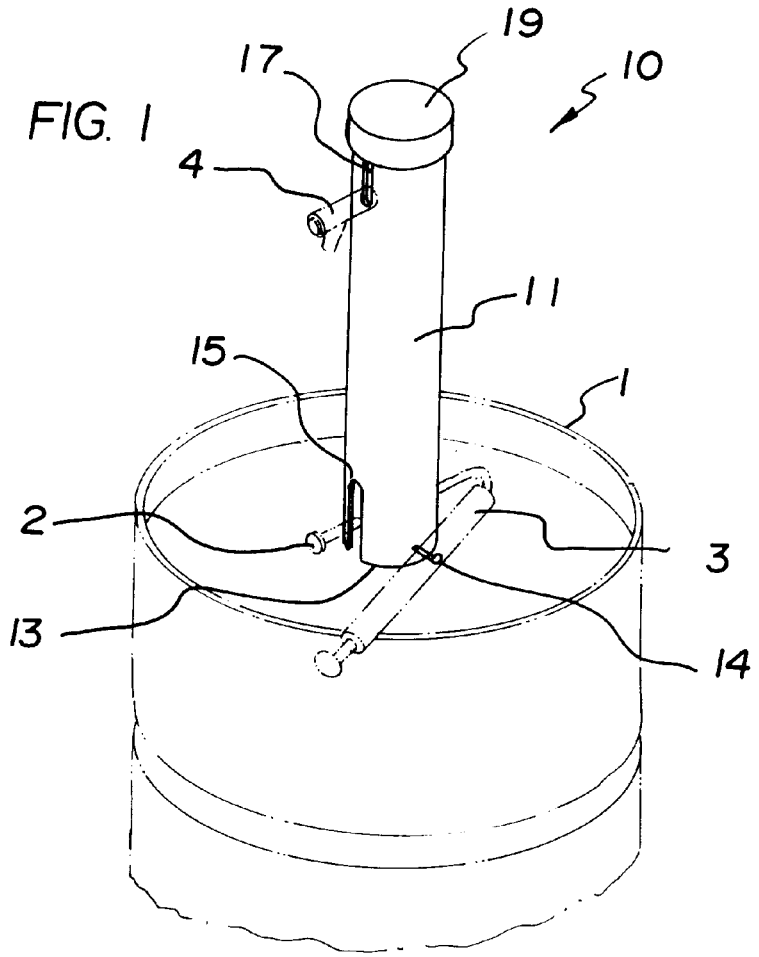
FIG. 1 is a schematic perspective view of a new keg tap cooling device in use according to the present invention.
Figure 2:
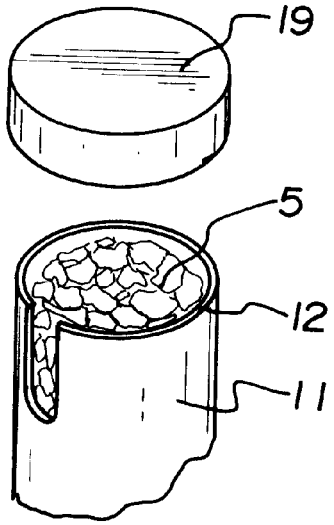
FIG. 2 is a schematic exploded partial perspective view of the present invention.
Figure 4:
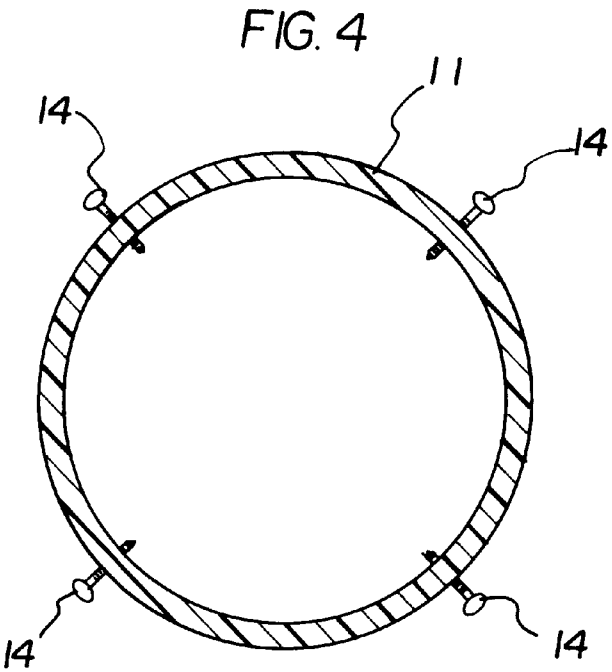
FIG. 4 is a schematic cross sectional view of the present invention taken from line 4—4 of FIG. 3.
Figure 3:
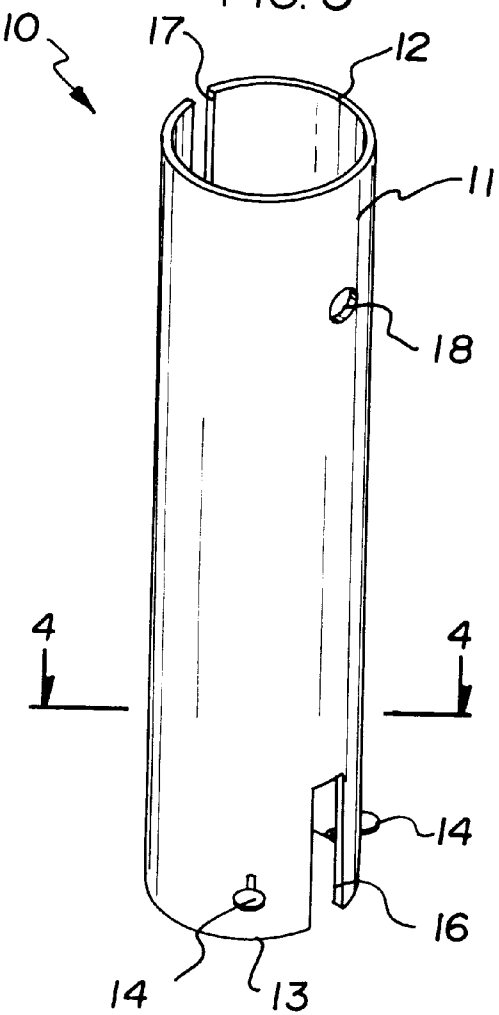
FIG. 3 is a schematic perspective view of the present invention.
Figure 5:
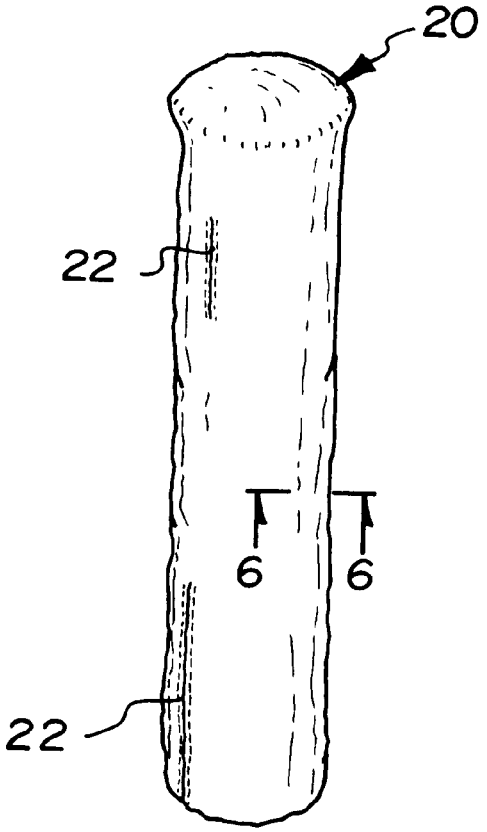
FIG. 5 is a schematic perspective view of the insulated cover.
Figure 6:
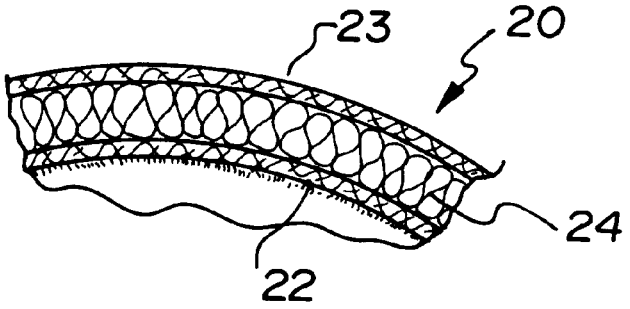
FIG. 6 is a schematic cross sectional view of the insulated cover taken from line 6—6 of FIG. 5.

With reference now to the drawings, and in particular to FIGS. 1 through 6 thereof, a new keg tap cooling device embodying the principles and concepts of the present invention and generally designated by the reference numeral 10 will be described.

As best illustrated in FIGS. 1 through 6, the keg tap cooling device 10 generally comprises an elongate tube 11 having open top and bottom ends 12,13. The bottom end 13 of the tube 11 is adapted for receiving therein a keg tap mounted to the top end of a beverage keg 1 such that a pour tube 11 of the keg tap extends in the lumen of the tube 11 towards the top end 12 of the tube 11. The lumen of the tube 11 is adapted for holding a cooling material 5 therein for cooling the pour tube 11 of the keg tap in the lumen.

In use, the device 10 is designed for cooling a keg tap mounted to the top end of a beverage keg 1. The keg tap is in fluid communication with the bunghole 18 of the beverage keg 1. The keg tap has a mounting mechanism 2 for mounting the keg tap to the top end 12 of the beverage keg 1, a pump mechanism 3 for pumping fluid out of the beverage keg 1, and a pouring tube 4 has a nozzle for pouring fluid out of the beverage keg 1. In closer detail, the device 10 includes an elongate tube 11 has a lumen, open top and bottom ends 12,13, and a longitudinal axis extending between the top and bottom ends 12,13 of the tube 11. The tube 11 is generally cylindrical such that the top and bottom ends 12,13 form generally circular openings into the lumen of the tube 11. The top and bottom ends 12,13 of the tube 11 preferably lie in generally parallel planes which are generally perpendicular to the longitudinal axis of the tube 11. Ideally, the tube 11 comprises PVC pipe conduit has a diameter of about 4 inches and a length defined between the top and bottom ends 12,13 of about 18 inches. In use, the bottom end 13 of the tube 11 is adapted for receiving therein a keg tap mounted to the top end of a beverage keg 1 such that a pour tube 11 of the keg tap extends in the lumen of the tube 11 towards the top end 12 of the tube 11.

The tube 11 has a holding assembly adapted for releasably holding the bottom end 13 of the tube 11 to the top end 12 of the beverage keg 1. Preferably, the holding assembly of the tube 11 comprises a number of spaced apart threaded thumb screws 14 threadedly extended through holes in the tube 11 adjacent the bottom end 13 of the tube 11. Ideally, the number of threaded thumb screws 14 comprises four threaded thumb screws. In use, tightening of the threaded thumb screws 14 advances the thumb screws into the lumen of the tube 11 and against the neck of the top end 12 of the beverage keg 1 to hold the bottom end 13 of tube 11 to the neck of the beverage keg 1. In use, the lumen of the tube 11 is adapted for holding a cooling material 5 therein for cooling the pour tube 11 of the keg tap in the lumen to help prevent excessive foaming of beer poured from the nozzle of the pouring tube 4. Ideally, the cooling material comprises ice.

The tube 11 has an elongate first bottom slot 15 therethrough. The first bottom slot 15 has a length extending upwards from the bottom end 13 of the tube 11 towards the top end 12 of the tube 11. The length of the first bottom slot 15 extending generally parallel to the longitudinal axis of the tube 11. The first bottom slot 15 of the tube 11 is adapted for extending a mounting mechanism 2 of the keg tap therethrough. The first bottom slot 15 preferably has a generally U-shaped periphery. The tube 11 also has an elongate second bottom slot 16 therethrough. The second bottom slot 16 has a length extending upwards from the bottom end 13 of the tube 11 towards the top end 12 of the tube 11. The length of the second bottom slot 16 extends generally parallel to the longitudinal axis of the tube 11. The second bottom slot 16 is located at a generally diametric point on the tube 11 from the first bottom slot 15 of the tube 11. In use, the second bottom slot 16 of the tube 11 is adapted for extending a pump mechanism 3 of the keg tap therethrough. The second bottom slot 16 preferably has a generally rectangular periphery.

The tube 11 has an elongate top slot 17 therethrough. The top slot 17 has a length extending from the top end 12 of the tube 11 towards the bottom end 13 of the tube 11. The length of the top slot 17 extends generally parallel to the longitudinal axis of the tube 11. The length of the top slot 17 is generally collinear with the length of the first bottom slot 15. In use, the top slot 17 of the tube 11 is adapted for extending a nozzle of a pouring tube 4 of the keg tap therethrough. The top slot 17 has a generally U-shaped periphery. Preferably, the top slot 17 and the first and second bottom slots 15,16 each have length less than about one-half the length of the tube 11. Even more preferably, the lengths of the top slot 17 and the first and second bottom slots 15,16 are greater than about one-sixteenth the length of the tube 11. Ideally, the lengths of the top slot 17 and the first and second bottom slots 15,16 are between about one-eighth and about one-fourth the length of the tube 11.

The tube 11 has a hole 18 therethrough. The hole 18 of the tube 11 has a generally circular periphery. The hole 18 of the tube 11 is positioned toward the top end 12 of the tube 11. The hole 18 of the tube 11 is located at a generally diametric point on the tube 11 from the top slot of the tube 11. The hole 18 of the tube 11 has a center generally collinear with the length of the second bottom slot 16. The center of the hole 18 is positioned generally along a common plane with the arcuate portion of the periphery of the top slot of the tube 11. In use, the hole 18 of the tube 11 is adapted for extending an end of the pour tube 11 of the keg tap therethrough to permit attachment of a bar style spigot to the end of the pout tube 11.

A cap 19 for substantially covering the top end 12 of the tube 11. The cap 19 has a generally circular top and a generally cylindrical lower lip that extends around the top end 12 of the tube 11 when the cap 19 covers the top end 12 of the tube 11. Optionally provided, a tubular insulated cover 20 configured for covering the tube 11 and has a bottom opening adapted for inserting the tube 11 into the insulated cover 20. The insulated cover 20 has a number of slits 21 adapted and positioned on the insulated cover 20 for permitting covering and uncovering of the top slot, the hole 18, and the first and second bottom slots 15,16. The insulated cover 20 has fabric material inner and outer layers 22,23 and a middle layer 24 comprising an insulating material.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for cooling a keg tap mounted to the top end of a beverage keg, said device comprising:

an elongate tube having a lumen, open top and bottom ends, and a longitudinal axis extending between said top and bottom ends of said tube;

said bottom end of said tube being adapted for receiving therein a keg tap mounted to the top end of a beverage keg such that a pour tube of the keg tap extends in said lumen of said tube towards said top end of said tube; and said lumen of said tube being adapted for holding a cooling material therein for cooling the pour tube of the keg tap in said lumen.

2. The device of claim 1, wherein said tube is substantially cylindrical such that said top and bottom ends form substantially circular openings into said lumen of said tube.

3. The device of claim 1, wherein said top and bottom ends of said tube lie in substantially parallel planes, said planes of said top and bottom ends of said tube being substantially perpendicular to said longitudinal axis of said tube.

4. The device of claim 1, wherein said tube has a holding assembly adapted for releasably holding said bottom end of said tube to the top end of the beverage keg.

5. The device of claim 4, wherein said holding assembly of said tube comprises a number of spaced apart threaded screws threadedly extended through said tube.

6. The device of claim 1, wherein said tube has an elongate first bottom slot therethrough, said first bottom slot having a length extending from said bottom end of said tube towards said top end of said tube.

7. The device of claim 6, wherein said tube has an elongate second bottom slot therethrough, said second bottom slot having a length extending from said bottom end of said tube towards said top end of said tube.

8. The device of claim 1, wherein said tube has an elongate top slot therethrough, said top slot having a length extending from said top end of said tube towards said bottom end of said tube.

9. The device of claim 1, wherein said tube has a hole therethrough, said hole of said tube having a substantially circular periphery, said hole of said tube being positioned toward said top end of said tube.

10. The device of claim 1, further comprising a cap for covering said top end of said tube.

11. A device for cooling a keg tap mounted to the top end of a beverage keg, the keg tap having a mounting mechanism for mounting the keg tap to the top end of the beverage keg, a pump mechanism for pumping fluid out of the beverage keg, and a pouring tube having a nozzle for pouring fluid out of the beverage keg, said device comprising:

an elongate tube having a lumen, open top and bottom ends, and a longitudinal axis extending between said top and bottom ends of said tube;

said tube being substantially cylindrical such that said top and bottom ends form substantially circular openings into said lumen of said tube;

said top and bottom ends of said tube lying in substantially parallel planes, said planes of said top and bottom ends of said tube being substantially perpendicular to said longitudinal axis of said tube;

said bottom end of said tube being adapted for receiving therein a keg tap mounted to the top end of a beverage keg such that a pour tube of the keg tap extends in said lumen of said tube towards said top end of said tube;

said tube having a holding assembly adapted for releasably holding said bottom end of said tube to the top end of the beverage keg, wherein said holding assembly of said tube comprises a number of spaced apart threaded screws threadedly extended through said tube adjacent said bottom end of said tube, wherein said number of threaded screws comprises four threaded screws;

said lumen of said tube being adapted for holding a cooling material therein for cooling the pour tube of the keg tap in said lumen, wherein said cooling material comprises ice;

said tube having an elongate first bottom slot therethrough, said first bottom slot having a length extending from said bottom end of said tube towards said top end of said tube, said length of said first bottom slot extending substantially parallel to said longitudinal axis of said tube;

said first bottom slot of said tube being adapted for extending a mounting mechanism of the keg tap therethrough;

said first bottom slot having a substantially U-shaped periphery;

said tube having an elongate second bottom slot therethrough, said second bottom slot having a length extending from said bottom end of said tube towards said top end of said tube, said length of said second bottom slot extending substantially parallel to said longitudinal axis of said tube, said second bottom slot being located at a substantially diametric point on said tube from said first bottom slot of said tube;

said second bottom slot of said tube being adapted for extending a pump mechanism of the keg tap therethrough;

said second bottom slot having a substantially rectangular periphery;

said tube having an elongate top slot therethrough, said top slot having a length extending from said top end of said tube towards said bottom end of said tube, said length of said top slot extending substantially parallel to said longitudinal axis of said tube, said length of said top slot being substantially collinear with said length of said first bottom slot;

said top slot of said tube being adapted for extending a nozzle of a pouring tube of the keg tap therethrough;

said top slot having a substantially U-shaped periphery, said tube having a hole therethrough, said hole of said tube having a substantially circular periphery, said hole of said tube being positioned toward said top end of said tube, said hole of said tube being located at a substantially diametric point on said tube from said top slot of said tube, said hole of said tube having a center substantially collinear with said length of said second bottom slot;

said hole of said tube being adapted for extending an end of the pour tube of the keg tap therethrough; and a cap for covering said top end of said tube.

* * * * *